US010583323B2

(12) United States Patent
Little

(10) Patent No.: US 10,583,323 B2
(45) Date of Patent: Mar. 10, 2020

(54) PORTABLE EXERCISE DEVICE

(71) Applicant: Casey Little, East Point, GA (US)

(72) Inventor: Casey Little, East Point, GA (US)

( * ) Notice: Subject to any disclaimer, the term of this patent is extended or adjusted under 35 U.S.C. 154(b) by 213 days.

(21) Appl. No.: 15/443,042

(22) Filed: Feb. 27, 2017

(65) Prior Publication Data

US 2018/0243603 A1 Aug. 30, 2018

(51) Int. Cl.

| | |
|---|---|
| ***A63B 23/10*** | (2006.01) |
| ***A63B 21/065*** | (2006.01) |
| ***A63B 23/02*** | (2006.01) |
| ***A63B 21/00*** | (2006.01) |
| ***A63B 21/072*** | (2006.01) |
| *A63B 69/00* | (2006.01) |

(52) U.S. Cl.

CPC ..... *A63B 23/0216* (2013.01); *A63B 21/065* (2013.01); *A63B 21/0728* (2013.01); *A63B 21/4015* (2015.10); *A63B 2069/0062* (2013.01); *A63B 2208/0233* (2013.01); *A63B 2208/0252* (2013.01); *A63B 2209/00* (2013.01); *A63B 2210/00* (2013.01)

(58) Field of Classification Search

CPC ..... A63B 21/065; A63B 21/4015

See application file for complete search history.

(56) References Cited

U.S. PATENT DOCUMENTS

| | | | | |
|---|---|---|---|---|
| 2,214,052 | A * | 9/1940 | Good | A63B 21/065 36/132 |
| 3,850,430 | A * | 11/1974 | Hamilton | A63B 21/0615 482/97 |
| 6,196,950 | B1 * | 3/2001 | Emick | A63B 21/065 482/105 |
| 6,238,325 | B1 * | 5/2001 | Oxford | A63B 21/0004 482/146 |
| 6,592,497 | B2 * | 7/2003 | Greenheck | A63B 21/072 482/46 |
| 6,878,102 | B1 * | 4/2005 | Commisso | A61H 1/0266 482/146 |
| 9,017,231 | B2 * | 4/2015 | Kosich | A63B 21/065 482/105 |
| 2018/0290009 | A1 * | 10/2018 | Avila | A63B 21/4015 |

* cited by examiner

*Primary Examiner* — Joshua T Kennedy

(57) ABSTRACT

An exercise device comprises adjustable apparatus for engaging the feet of a user, including sole-support members positioned for receiving the soles of a user's feet, an adjustable heel engaging member that is positioned to be adjusted relative to the sole-support members, and a pivotally adjustable member positioned to engage the top of a user's feet, and further including one or more members for adding weights to the device.

12 Claims, 5 Drawing Sheets

PORTABLE EXERCISE DEVICE

TECHNICAL FIELD

This disclosure relates in general to exercise equipment and, in particular, to a portable exercise device providing weight training for a user's abdominal muscles and leg muscles, the exercise device being portable in size and construction.

BACKGROUND OF THE DISCLOSURE

Exercise equipment for home use is very popular since it enables people to engage in exercise routines at home without having to buy expensive gym memberships or find the time to go to the gym. Consequently, many exercise devices have been developed for home use. Certain home-designed exercise equipment has even been developed for use in commercial gym settings.

Of particular relevance to the present invention are exercise devices that have been developed for exercising the abdominal muscles. Devices for this purpose are disclosed in U.S. Pat. No. 7,097,602 to Kim; U.S. Pat. No. 7,232,404 to Nelson; U.S. Pat. No. 8,012,072 to Forcilla; U.S. Pat. No. 7,614,986 to Mattox; and U.S. Pat. No. 5,843,357 to Jones. These devices vary in their means of operation to exercise the abdominal muscles. For example, U.S. Pat. No. 7,097,602 is directed to a device that is placed on and moved by the abdominal muscles as a means of strengthening those muscles. U.S. Pat. No. 7,232,404 discloses a device that employs a slidable platform on which the user kneels such that the user's abdominal muscles become the instrument for effecting movement of the slidable platform. U.S. Pat. Nos. 5,853,357; 8,012,072 and 4,623,144 each disclose a device that employs ancillary movement of the arms, is a region above the waist, against a weight or resistance device to exercise the abdominal muscles.

Additionally, U.S. Pat. No. 9,017,231 to Kosich discloses a device for use in exercising a user's upper and lower leg muscles. The Kosich device discloses a vertically extending structure having a foot-engaging portion at the top of two parallel structures with barbell weights attached to the parallel structures. An alternative embodiment of the Kosich device comprises a foot strap on either side of which is a weight.

SUMMARY

In a first aspect of the disclosure, embodiments are disclosed of an exercise device comprising a base support, adjustable apparatus for adjustably engaging the feet of a user in proximity to the base support, and at least one weight attaching member positioned relative to the base support. The apparatus of this aspect has a particular advantage of providing a portable exercising device that enables the device to be adjusted to the user's feet, or shoewear, and to be fitted with various types and degrees of weight to incrementally develop strength in leg and abdominal muscles.

In certain embodiments, the adjustable apparatus for engaging the feet of a user further comprises, sole-support members positioned for receiving the soles of a user's feet, an adjustable heel engaging member that is positioned to be adjusted relative to the sole-support members, and a pivotally adjustable member positioned to engage the top of a user's feet.

In other certain embodiments, the pivotally adjustable member is slidably adjustable relative to the sole-support members.

In yet another embodiment, the at least one weight attaching member further comprises a threaded rod that is oriented generally perpendicularly to the base support.

In still another embodiment, the at least one weight attaching member further comprises a second threaded rod that is oriented longitudinally to the base support.

In certain embodiments, the at least one weight attaching member may comprise a threaded rod that is oriented at an angle to the threaded rod that is oriented generally perpendicularly to the base support.

In other embodiments, the exercise device further comprises a weight engaged on the at least one weight attaching member.

In yet other embodiments, the weight engaged on the at least one weight attaching member is releasably engaged therewith.

In certain embodiments, the exercise device further comprises a second weight attaching member and has a second weight member engaged with the second weight attaching member.

In still other embodiments, the second weight member is releasably engaged with the second weight attaching member.

In other embodiments, the adjustable heel engaging member is slidably adjustable relative to the base support.

In some embodiments, the exercise device further comprises a locking mechanism for securing the relative position of the adjustable heel engaging member relative to the base support.

In still other embodiments, the at least one weight attaching member is releasably attached relative to the base support.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments in which.

DETAILED DESCRIPTION

Figure 1:
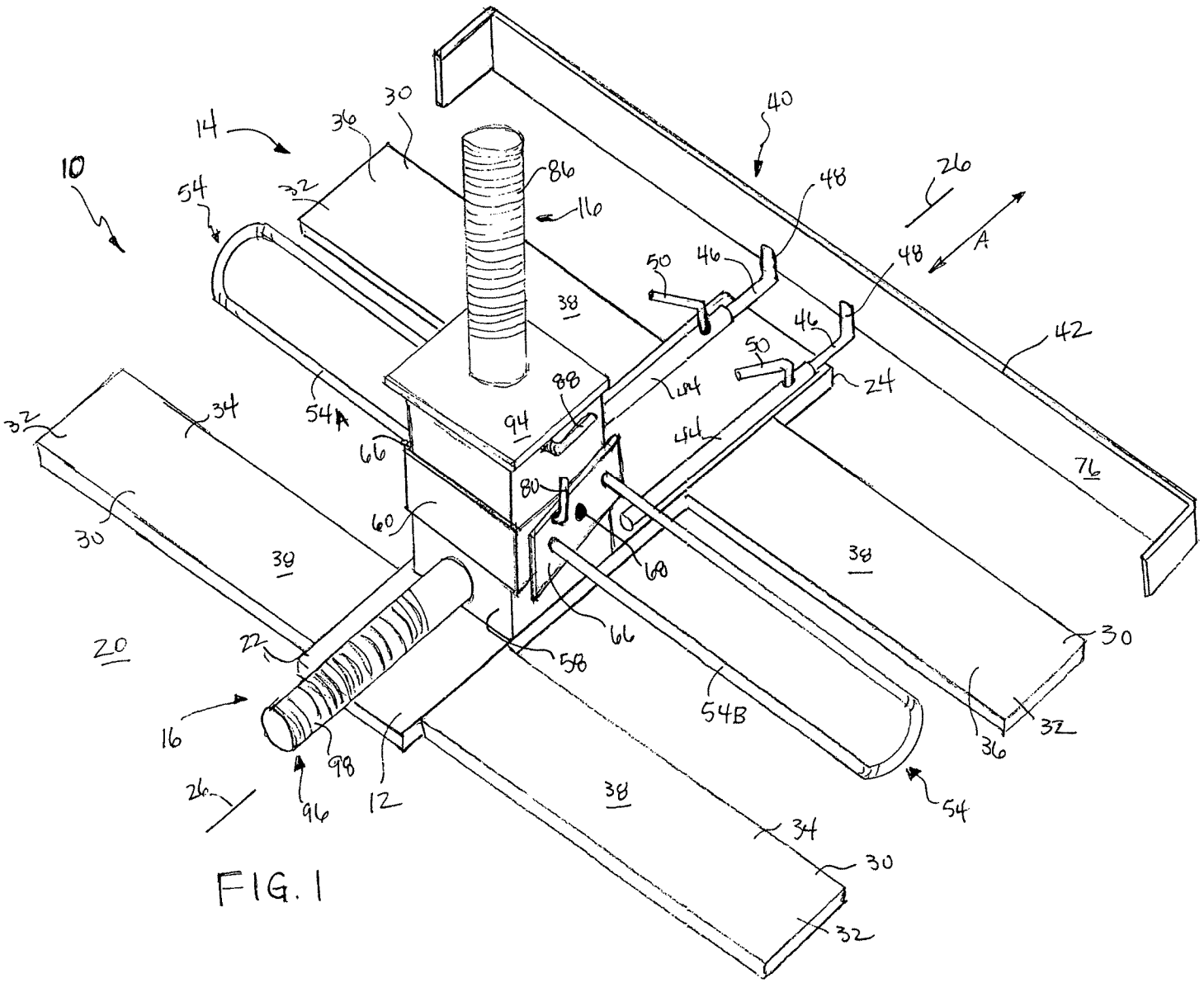
FIG. 1 is a perspective view of the exercise device in accordance with this disclosure.

The exercise device 10 of the present disclosure is generally shown in FIG. 1. It is to be understood that the depiction of the device shown in FIGS. 1-5 is but one example of carrying out the structural features of the invention, and are not intended to be limiting of the type, construction or configuration of the elements described herein.

The device 10 is principally comprised of a base support 12, adjustable apparatus 14 for engaging the feet of a user in proximity to the base support 12 and at least one weight attaching member 16 positioned relative to the base support 12. The base support 12 provides a main support structure for the adjustable apparatus 14 and the at least one weight attaching member 16. The base support 12 is structured for being positioned, at least initially, on the ground or floor surface 20, to enable the user to engage the device 10 on the user's feet, as described more fully hereinafter. The base support 12 may be structured from an elongated length of material, such as wood or metal or plastic, and has a forward end 22 and a rearward end 24. The base support 12 has a long axis 26 extending between the forward end 22 and rearward end 24.

The adjustable apparatus 14 comprises sole-support members 30 positioned for receiving the soles of a user's feet. As shown in FIG. 1, the sole-support members 30 may be structured as planar members 32 that extend outwardly from the base support 12 is a lateral direction to the long axis of the base support, and may comprise forward members 34 and rearward members 36. Each of the sole-support members 30 provides an upper surface 38 against which the soles of the user's feet or the soles of the user's shoes are received. While four planar members 32 are shown, the sole-support members may be greater or lesser in number and may be shaped, configured or sized in a variety of different ways, as long as they provide sufficient support for the user's feet or shoes.

The sole-support members 30 may, most suitably, be secured to the base support 12. Alternatively, the sole-support members 30 may be releasably affixed to the base support 12 so that the sole-support members 30 can be optionally disengaged from a connection with the base support 12 for dismantling and storage or facilitated transport of the device 10. The sole-support members 30 may be made of any number of materials, including metal, wood, hardened plastic, resins or other materials.

The adjustable apparatus 14 further includes an adjustable heel engaging member 40 that is positioned to be adjusted relative to the sole-support members 30. By way of example, and as shown in FIG. 1, the heel engaging member 40 may comprise an elongated bar 42 that is positioned toward the rearward end of the base support 12. The elongated bar 42 is adjustable in a manner that enables the elongated bar 42 to move, in the direction of arrow A, toward or away from the rearward end 24 of the base support 12. One means of enabling such adjustability is to provide tubular housings 44 on the base support 12 that are sized to slidably receive a rod 46, one end 48 of which is affixed to the elongated bar 42. Thus, the elongated bar 42 can be moved closer to the base support 12 or moved away from the base support 12 by manually moving the elongated bar 42 to cause the rods 46 to slidably move into or out of the tubular housings 44. Locking devices 50 are provided through the tubular housings 44 to secure the rods 46 in place relative to the tubular housing 44 when the desired position of the elongated bar relative to the sole-support members 30 is achieved.

Figure 5:
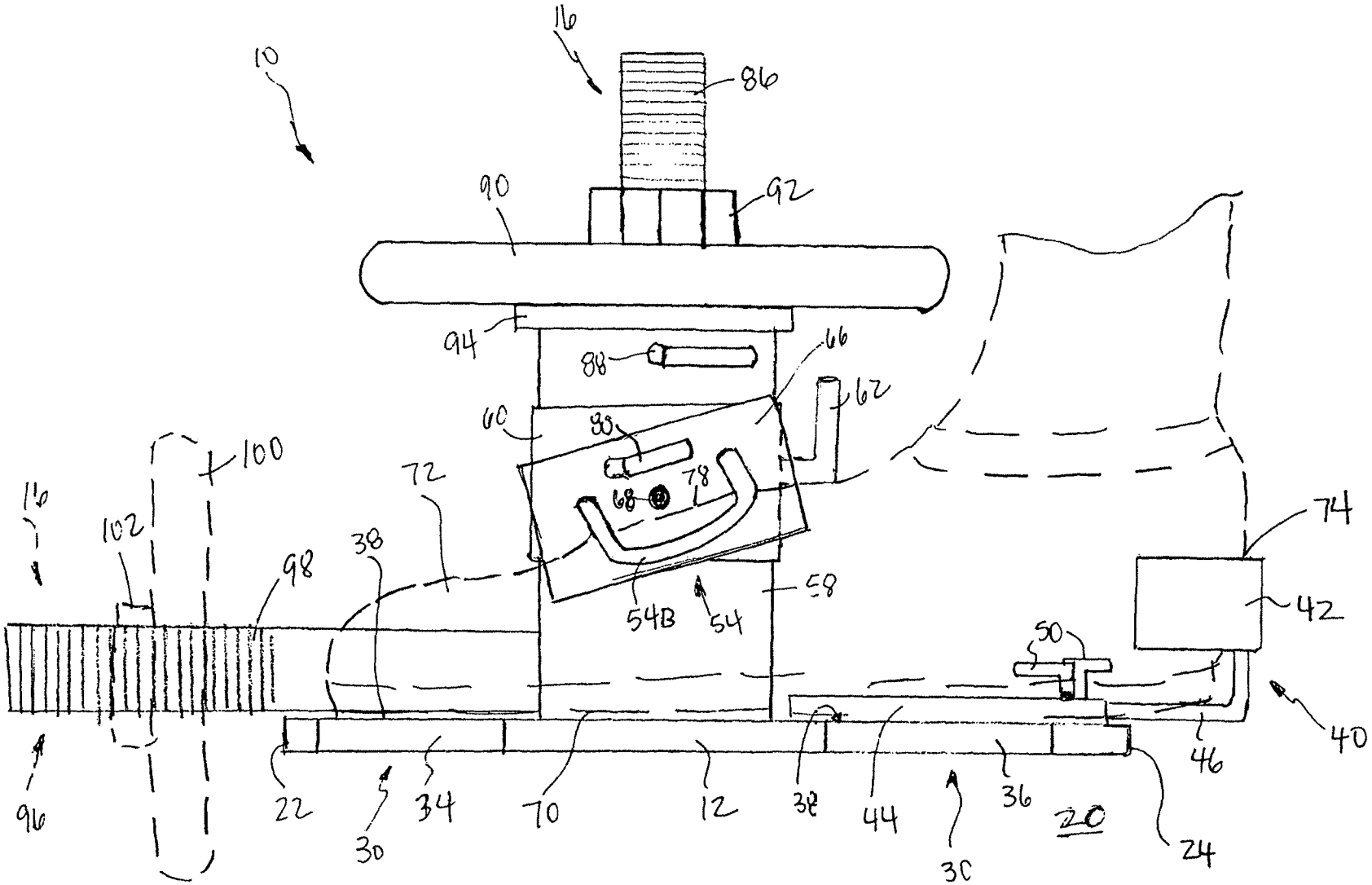
FIG. 5 is a side view in elevation illustrating the device in use.

The adjustable apparatus 14 further includes a pivotally adjustable member 54 that is positioned to engage the top of a user's feet or shoes when the soles of user's feet or shoes are engaged on the sole-support members 30. The pivotally adjustable member 54 is raised or positioned in elevation above the sole-support members 30 to engage the top of the user's foot or shoe, as illustrated in FIG. 5. Additionally, the pivotally adjustable member 54 is adjustable in elevation or in distance away from the sole-support members 30, in the direction of arrow B.

Figure 2:
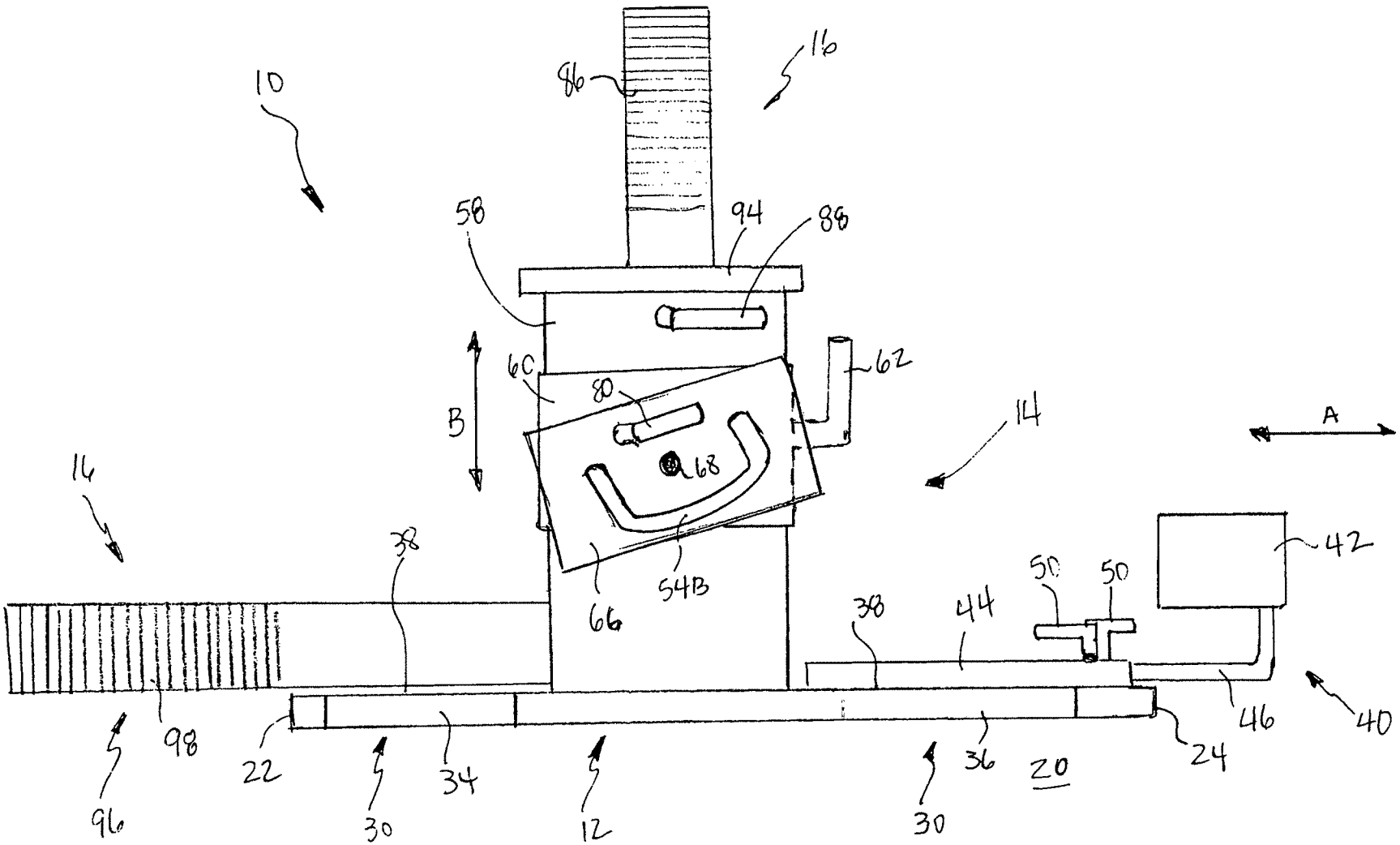
FIG. 2 is a side view in elevation of the exercise device shown in FIG. 1.
Figure 3:
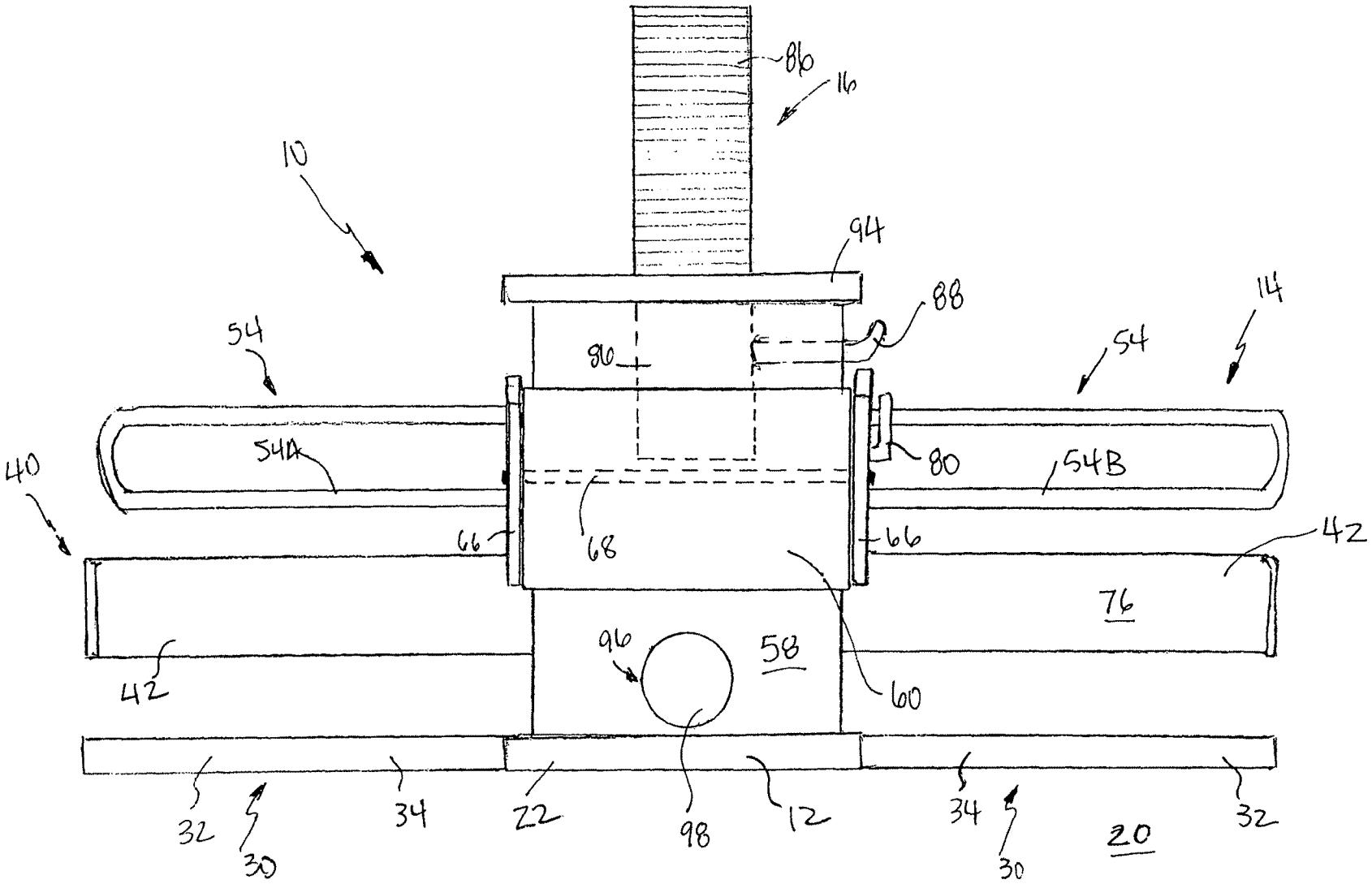
FIG. 3 is a front view in elevation of the exercise device shown in FIG. 1.

Accordingly, a central housing 58 is positioned on the base support 12, between the forward end 22 and rearward end 24 thereof. An adjustable collar 60 is positioned to encircle the central housing 58 and is slidably adjustable relative to the central housing 58 in the direction of arrow B, or up and down relative to the central housing 58. As best seen in FIG. 2, a locking mechanism 62 is provided for locking the adjustable collar 60 in place on the central housing 58 once the relative height position of the adjustable collar 60 is achieved.

Two plates 66, one each positioned on opposing sides of the central housing 58, provide pivotal movement of the pivotally adjustable member 54, which comprises a right pivotally adjustable member 54A and a left pivotally adjustable member 54B. A best seen in FIG. 3, the two plates are journalled together via a pivot pin 68 that extends through the central housing 58 and is rotatable relative to the central housing 58. As also shown in FIG. 2, each of the right pivotally adjustable member 54A and left pivotally adjustable member 54B is connected to a respective plate 66. Consequently, the right pivotally adjustable member 54A and left pivotally adjustable member 54B are pivotable together by virtue of their respective attachment to the two plates 66, which, in turn, are pivotable together by virtue of their connection to the pivot pin 68.

Figure 4:
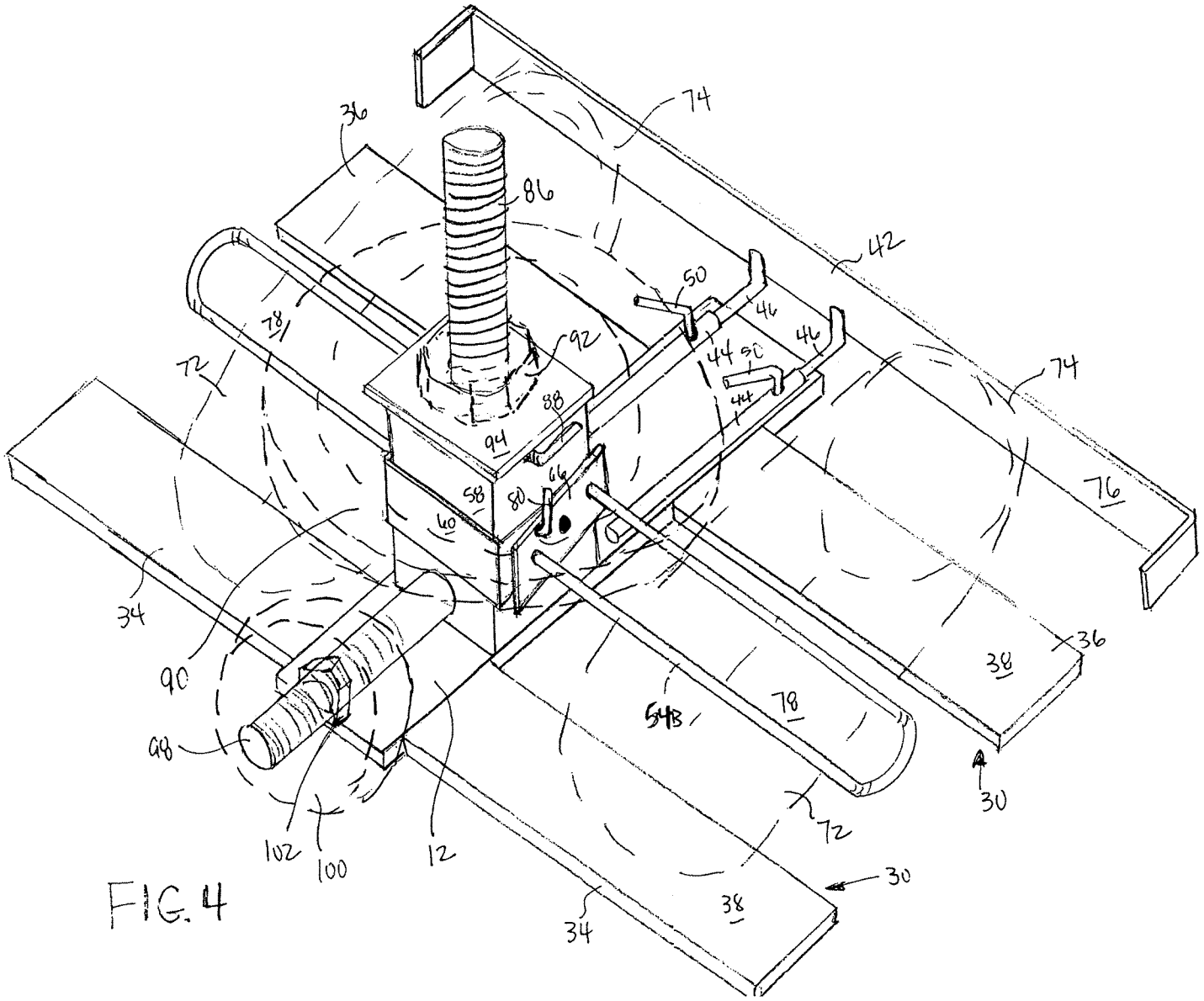
FIG. 4 is perspective view of the exercise device shown in use.

In use, the pivotally adjustable members 54A and 54B can be raised in elevation, or away from, the sole-support members 30 by loosening the locking mechanism 62 and moving the adjustable collar 60 upwardly relative to the central housing 58. The user then places his feet, or preferably his shoes, so that the soles 70 of the shoes 72 are brought to rest on the upper surface 38 of the sole-support members 30. The elongated bar 42 of the heel-engaging member 40 is then adjusted in the direction of arrow A until the inner surface 76 of the elongated bar 42 is brought into registration with the heel 74 of the user's shoes 72, as seen in FIGS. 4 and 5. The position of the elongated bar 42 is then maintained by manipulating the locking mechanisms 50 of the rods 46 to lock the elongated bar 42 into position in registration with the user's shoes 72.

The adjustable collar 60 is then lowered until the pivotally adjustable members 54A and 54B are brought into registration with the top 78 of the user's shoes 72, as shown in FIGS. 4 and 5. The pivotally adjustable members 54A and 54B are then pivotally rotated to properly engage the top 78 of the user's shoes 72, as shown in FIG. 5. The pivotally adjustable members 54A and 54B are then locked into position by manipulation of a plate locking device 80 which secures the position of the two plates 66 relative to the central housing 58. At this point, the user's feet or shoes 72 are secured into proper positioning within the exercise device 10.

The exercise device 10 is configured to support weights on the device 10 to carry out the desired exercises. Accordingly, at least one weight attaching member 16 is associated with the device 10. The weight attaching member 16 may comprise a threaded rod 86 that is secured to the central housing 58, and is oriented generally perpendicularly to the base support 12. By "generally perpendicular" is meant that the threaded rod 86 is positioned in an upright aspect relative to the central housing 58 and relative to the base support 12. However, the threaded rod 86 may be positioned or canted at an angle that is other than strictly perpendicular to the base support 12 or central housing 58.

The threaded rod 86 may be permanently affixed to, or formed as part of, the central housing 58. Alternatively, as suggested in FIG. 3, the threaded rod 86 may be releasably attached to the central housing 58 by provision of a locking arm 88 that extends through the central housing to engage the threaded rod 86 and lock it is place relative to the central housing 58. In such an embodiment, the threaded rod 86 may be removed for ease of storage or transportation.

The threaded rod 86 provides means for attaching weights to the exercise device 10. As shown in phantom in FIG. 4, and as shown in solid line in FIG. 5, a weight 90, such as a plate weight, is positionable on the threaded rod 86 and locked into place by a threaded nut 92. The weight 90 is supported on the central housing 58 by a support element 94 that caps the central housing 58. Any number and/or type of weights may be placed on the threaded rod 86 and secured in place, depending on the type and level of exercise that the user wishes to engage in.

The at least one weight attaching member 16 may also include a second weight attaching member 96 that is secured to the central housing 58 at an angle to the threaded rod 86. In one suitable embodiment, the second weight attaching member 96 is positioned along the long axis 26 of the base support 12 and is in parallel orientation to the long axis 26. The orientation of angle of the second weight attaching member 96 may be other than as shown and may, for example, be directed at an acute angle to the upper surface 38 of the base support 12.

The second weight attaching member 96 may be in the form of a second threaded rod 98. As depicted in phantom in both FIGS. 4 and 5, a weight 100, such as a plate weight, is attachable to the second threaded rod 98 and may be secured in place on the second threaded rod 98 with a threaded nut 102. In some embodiments of the exercise device 10, there may be a single weight attaching member 16, which may be either the threaded rod 86 or the second threaded rod 98. In other embodiments, the exercise device 10 may be structured with both the threaded rod 86 and the second threaded rod 98. More weight attaching members may be added to the exercise device 10 to provide greater directional balancing of the exercise device 10.

In use of the exercise device 10, the user positions his feet or shoes in the exercise device 10 as previously described herein. The user may have attached a desired amount of weights to the device 10 prior to inserting the feet or shoes in the device. Alternatively, weights may be added or subtracted from the device after inserting the feet or shoes in the device, or during use of the device 10. The exercise device 10 is particularly suitable for doing abdominal exercises where the user, once the user's feet or shoes are positioned in the device and a desired amount of weight has been positioned on the device, reclines on a surface, such as a floor or an elevated exercise bench, and raises the legs above the level of the hips. The lifting of the feet is brought about by the contracting of the abdominal muscles, which are consequently strengthened by the exercise routine. The user's leg muscles are also employed in conducting the lifting exercise and are exercised as a result.

The exercise device 10 may also be used to exercise and strengthen the user's upper leg muscles by conducting exercises where the feet, engaged in the device, are rotated upwardly and downwardly relative to the knees. The exercise device 10 may also be adapted for engagement by other parts of the body, such as an arm secured between the sole-support members and pivotally adjustable members while gripping the elongated bar 42 with the hand, to perform upper body exercises involving, for example, the deltoid and pectoralis muscles.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. An exercise device, comprising:

a base support having a forward end and a rearward end;

adjustable apparatus for engaging the feet of a user in proximity to the base support, the adjustable apparatus comprising an adjustable heel engaging member that is positioned at the rearward end of the base support to be slidably adjustable relative to the base support, and a pivotally adjustable member positioned to engage, and pivot near, the top of the user's feet in use, the pivotally adjustable member being supported on and by a central housing attached to the base support and located between the forward end and rearward end of the base support, the pivotally adjustable member being attached to a collar that is slidably attached to the central housing; and at least one weight attaching member positioned relative to the base support.

2. The exercise device of claim 1, wherein the adjustable apparatus for engaging the feet of the user further comprises sole-support members positioned for receiving the soles of a user's feet.

3. The exercise device of claim 2, wherein the pivotally adjustable member is slidably adjustable relative to the sole-support members.

4. The exercise device of claim 3, wherein the at least one weight attaching member further comprises a threaded rod that is oriented generally perpendicularly to the base support.

5. The exercise device of claim 4, wherein the at least one weight attaching member further comprises a second threaded rod that is oriented longitudinally to the base support.

6. The exercise device of claim 4, wherein the at least one weight attaching member is releasably attached relative to the base support.

7. The exercise device of claim 1, wherein the at least one weight attaching member further comprises a threaded rod that is oriented at an angle to the threaded rod that is oriented generally perpendicularly to the base support.

8. The exercise device of claim 1, further comprising a weight engaged on the at least one weight attaching member.

9. The exercise device of claim 8, wherein the weight engaged on the at least one weight attaching member is releasably engaged therewith.

10. The exercise device of claim 8, further comprising a second weight attaching member and having a second weight member engaged with the second weight attaching member.

11. The exercise device of claim 10, wherein the second weight member is releasably engaged with the second weight attaching member.

12. The exercise device of claim 1, further comprising a locking mechanism for securing the relative position of the adjustable heel engaging member relative to the base support.

* * * * *